United States Patent [19]

Lacourciere

[11] Patent Number: 4,943,448

[45] Date of Patent: Jul. 24, 1990

[54] COATING APPLICATION SYSTEM FOR HIGH VOLTAGE TERMINALS AND AREAS THEREAROUND AND METHOD

[75] Inventor: Robert C. Lacourciere, West Hartford, Conn.

[73] Assignee: Leaksealers, Inc., West Hartford, Conn.

[21] Appl. No.: 257,767

[22] Filed: Oct. 14, 1988

[51] Int. Cl.[5] ..... B05D 5/12

[52] U.S. Cl. ..... 427/58; 427/421; 118/313; 118/323; 239/162; 239/165; 239/175; 174/5 R

[58] Field of Search ..... 118/313, 323; 427/421, 427/58, 27; 239/162, 165, 164, 167, 170, 172, 175; 174/5 R, 55 B

[56] References Cited

U.S. PATENT DOCUMENTS

| | | | |
|---|---|---|---|
| 2,263,319 | 11/1941 | Treanor | 174/5 R X |
| 3,019,287 | 1/1962 | Newcomb, Jr. et al. | 174/5 R X |
| 3,044,900 | 7/1962 | Ford | 427/58 X |
| 3,139,948 | 7/1964 | Rorden | 174/5 R X |
| 3,243,504 | 3/1966 | Johnson | 174/5 R X |
| 4,388,484 | 6/1983 | York | 174/5 R |

OTHER PUBLICATIONS

"Distribution Transformers"; Electrical World; vol. 154, No. 6; 8-8-60; pp. 66-67.

*Primary Examiner*—Shrive Beck
*Assistant Examiner*—Alain Bashore
*Attorney, Agent, or Firm*—McCormick, Paulding & Huber

[57] ABSTRACT

A system applying a coating material to surfaces situated adjacent to or on live, high voltage electrical bus work or the like utilizes a liquified coating material stored in containers and is electrically isolated from potential ground sources by a dielectric barrier. A pump means draws the coating material from the containers and transports the coating material through a conduit formed of a dielectrical material to a moveable cart supporting an applicator boom thereon which applies the coating material to the surfaces. The pump means is driven by compressed air which provides the pumps with a nonconductive fluid drive source eliminating an electrical potential or a potential ground source in the system.

22 Claims, 5 Drawing Sheets

COATING APPLICATION SYSTEM FOR HIGH VOLTAGE TERMINALS AND AREAS THEREAROUND AND METHOD

BACKGROUND OF THE INVENTION

The present invention relates to a system and a method for selectively applying a coating material onto a surface, and deals more particularly with a system providing a means for applying a dielectric material to surfaces situated adjacent to or on live, high voltage electrical terminals and bus work.

As is generally known, electrical power distribution systems utilize transformers which step up power to distribute it down line from the power source and subsequently utilize transformers to step down this power into usable voltage distributed to local communities and/or industries. These transformers generally provide three-phase power, with each transformer having a plurality of terminals extending outwardly, usually upwardly, from the body of the transformer to connect it with input and output lines. Each transformer is designed to have sufficient spacing between these terminals and between such terminals and ground source, to avoid what is commonly known as flashovers between differently phased terminals or between a single terminal and a source of ground potential. However, flashovers nevertheless sometimes unintentionally occur particularly when a small animal such as a squirrel leaps from one terminal to another or between a terminal and a source of ground. The flashover problem is substantially peculiar to transformers receiving input voltages ranging approximately between 14 kilovolts and 47 kilovolts. Flashovers in transformers receiving input voltages greater than 47 kilovolts do not occur very often since small animals seem to avoid such transformers, perhaps because of the strong electromagnetic flux generated around the transformer area by the increased voltage.

When a small animal creates a flashover in a transformer it becomes a conductor creating a short circuit usually causing the transformer to burn out. Loss of power to the area serviced by the transformer then occurs. Businesses effected are damaged by downtime or product spoilage, as in the case of a business selling refrigerated goods. In addition to these foreseeable damages, a further, more direct one is incurred when the transformer is replaced at a cost usually of millions of dollars. Moreover, replacement of the burnt-out transformer requires the utility company to switch and divert power to other transformers not normally servicing the area. Downtime for a single transformer not in use has been determined in some cases to cost a utility company approximately $7,000 per minute.

Different solutions have been tried to remedy the flashover problem in transformers. Fences have been erected around transformers but do not effectively enclose the transformers from animals since openings must be provided to allow access to the overhead lines. Another solution would be to manually insulate the terminal surfaces by utilizing workers who would cover the affected surfaces with insulation. Clearly, it is dangerous for workers to get close to live high voltage terminals since they are likely to be electrocuted. Thus, the transformers would have to be shut down in order that the workers be allowed to insulate. The cost, however, incurred by a utility company in disconnecting power to each transformer and subsequently insulating areas on each transformer affected by flashover is prohibitive. Thus, flashover problems in transformers must be remedied by a system which services live transformers while preserving worker safety.

Accordingly, in the present invention, it is an object of the invention to provide a system which applies a dielectric coating material to surfaces situated adjacent to or on high voltage electrical terminals and bus work when the transformer is live and which coating covers and insulates these surfaces thus preventing the problem of flashover occurring between these surfaces.

Another object of the present invention is to provide an electrically insulated mobile application system having adjustable components which are capable of being assembled to correspond in height and dimension with differently sized transformers.

Yet a further object of the invention is to provide a system isolating liquified coating material being pumped to live transformer terminals, bus work or to a transformer top surface from potential ground or electrical sources.

Yet a further object of the present invention is to provide a system having numerous electrical isolation redundancies which insure system safety by a factor of at least two.

SUMMARY OF THE INVENTION

The present invention resides in a system allowing application of a liquified coating material to live high voltage terminals and bus work including container means for storing the coating material, an applicator means for applying the coating material to the transformer surfaces, pump means which supply the applicator means with the coating material and conduit means connecting the pump means and the applicator means. The container means and the pump means are each supported on dielectric barriers and, as such, are electrically isolated from any potential ground source. The pump means is driven by an electrically, nonconductive fluid drive source which prevents the liquified coating material from being associated with an electrical potential or a ground source. The applicator means is formed from a dielectric material which electrically isolates the applicator means and the coating material being transported within the conduit from any potential ground source. The applicator means is supported for movement relative to the surfaces being covered. The system allows the liquified coating material to be pumped by the pump means from the container means through the conduit means to the applicator means without introducing a ground source or an electrical potential to the system.

DETAILED DESCRIPTION OF THE PREFERRED EMBODIMENT

Figure 1:
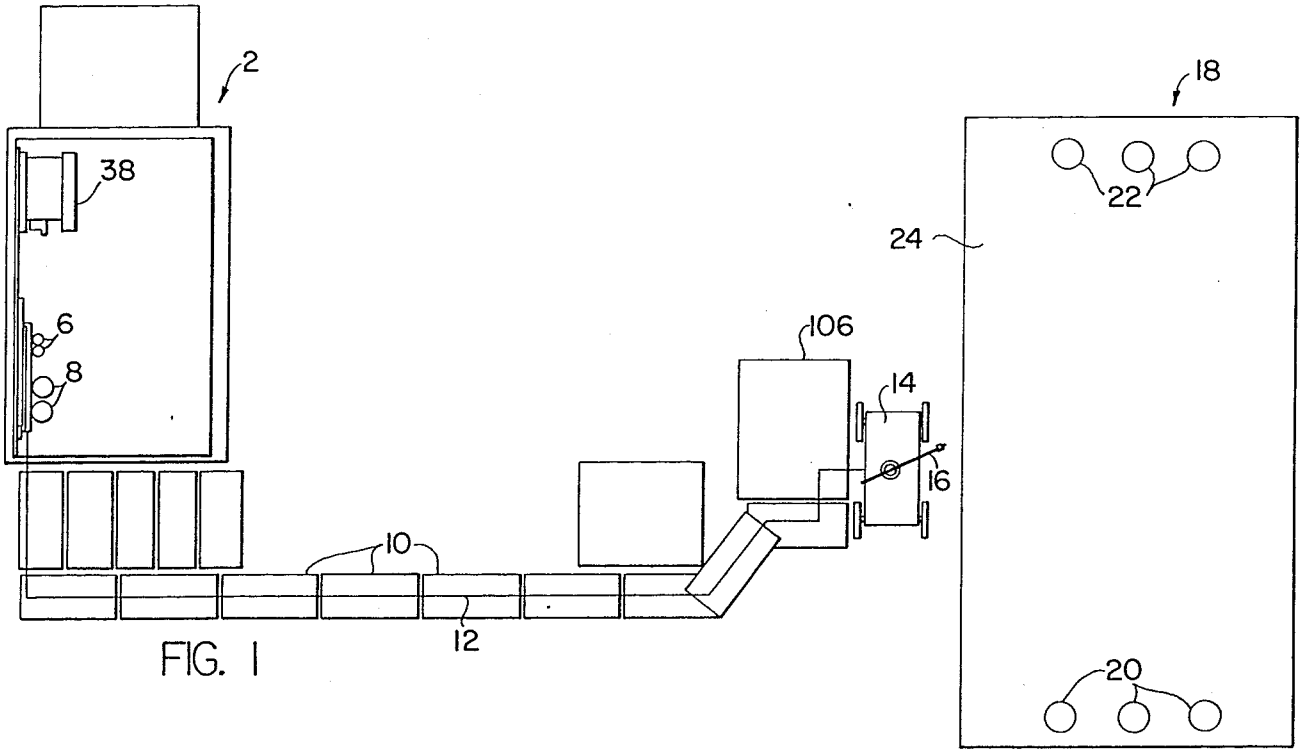
FIG. 1 is a plan view of the system embodying the present invention as laid out in the servicing operation.

As illustrated in the figures and first referring to FIG. 1, the application system according to the preferred embodiment of the invention includes an application vehicle 2 providing a mobile base supporting an air compressor 38 for driving pumps 6 which transport fluid stored in containers 8 and a supply conduit 12 connecting the pumps 6 to an application cart 14 supporting a manually controllable applicator boom 16. A transformer 18 is a three phase-power transformer used in an electrical distribution network. Three upstanding input terminals 20 connect to overhead input lines through bus work to provide, respectively, X, Y, and Z phase power to the transformer. Likewise, three upstanding X, Y, and Z terminals 22 connect to overhead output lines through bus work. A transformer top surface 24 supports each terminal in a spaced relationship with one another. The upper surface 24 can be situated at a variety of elevations above ground level depending on the size of the transformer being serviced.

As previously discussed, the system of the present invention is intended for use with transformers utilizing maximum voltages between 13.8 and 45.5 kilovolts. In theory, any grounding path introduced to the terminals 20 or 22 will not conduct the terminal voltage away from the terminals if the potential grounding path is separated from a ground source by a dielectric barrier having sufficient dielectric strength to resist conduction of the terminal voltage. However, dielectric material strengths may vary with environmental conditions. Accordingly, the system of the present invention provides a dielectric barrier having strength which resists conductivity of at least twice the maximum voltage utilized in any transformer being serviced. Below are listed the actual voltages found in particular transformers, the theoretically safe voltage for that transformer, the system strength and the safety ratio of the system determined by dividing the actual voltage of transformer by the system strength.

| ACTUAL VOLTAGE | THEORETICALLY SAFE VOLTAGE | SYSTEM STRENGTH | SYSTEM SAFETY RATIO |
|---|---|---|---|
| 13.8 KV | 14.0 KV | 115 KV | >8:1 |
| 23.7 KV | 25.0 KV | 115 KV | >4:1 |
| 45.5 KV | 47.0 KV | 115 KV | >2:1 |

As is clear, a minimum ratio of at least two is provided by the system. This mimimun safety factor is taken from an industry standard reflected by the dielectric strength found in lineman's gloves. Accordingly, the application system of the present invention may be used safely around live, transformer terminals because the system dielectric strength resists conduction of at least twice the terminal maximum voltage.

Figure 2:
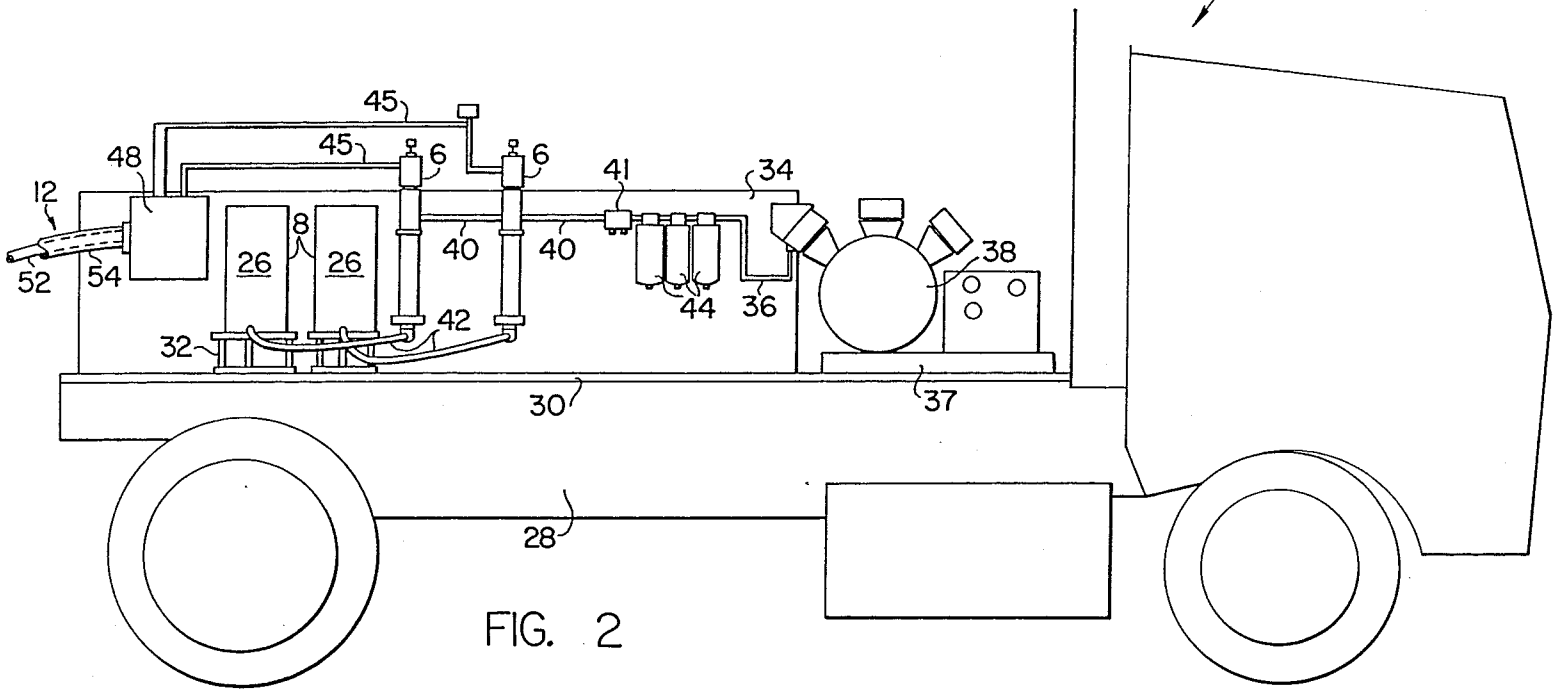
FIG. 2 is a side view taken along line 2—2 in FIG. 1 illustrating the application vehicle utilized in the system of the present invention.

In order that a dielectric material be remotely applied to the elevated upper surface 24 and the juxtaposed upstanding terminals 20 and 22, the coating material is actively transported from the application vehicle 2 to the surfaces which are intended to be covered. FIG. 2 illustrates the application vehicle 2 providing a mobile pumping station which electrically isolates the material being pumped from any grounding path. Containers 8 store the dielectric coating material 26 in liquid form. The containers 8 are sized to hold between 10 to 30 gallons and are preferably formed from plastic or the like. The vehicle bed 28 supports a mounting board 30 which in turn supports isolation stands 32 upon which containers 8 are placed. The mounting board 30 has a thickness of approximately 2 inches and is formed from a dielectric material such as fiberglass providing resistance to electrical conduction of approximately 120 kilovolts for the 2 inch thickness of material. Isolation stands 32 are formed from a like material and support the containers 8 in a spaced and elevated relationship with the mounting board 30 to create an additional dielectric barrier between the containers 8 and the vehicle bed 28. Thus, the coating material 26 while stored in the containers 8 in fluid form, is separated from any potential grounding source by a dielectric barrier having a strength resisting conduction of at least 115 kilovolts of electricity.

It should be understood that the coating material 26, when liquified, is conductive due to a solvent that is mixed with the dielectric material to liquify it. Thus, the system transporting the liquified coating material 26, must be isolated from any electrical potential. A vertically extending mounting board 34 identical in thickness and material type to that of board 30 rests on the horizontally extending mounting board 30 to provide an electrically isolated mounting wall upon which pumps 6 are fixed. The pumps 6 are positive displacement pumps and furthermore are driven by a nonconductive fluid drive source. The fluid drive is an important feature of the invention since it electrically isolates the pumps from the power source. Compressed air has been found to best provide the most reliable and nonconductive drive to the pumps because it produces a high kinetic energy drive without introducing an electrical potential to the pumps 6. The pumps 6 preferably employ a reciprocating piston which slides in a cylinder and defines two displacement chambers therein. The compressed air communicates with one of the displacement chambers and acts on one side of the piston to pressurize the coating material 26 communicating with the other displacement chamber and the opposite side of the piston. One such type of pump suitable for this purpose is the Comet High Volume Pump, Model No. 41-5030, made by BINKS and which is rated at five gallons per minute. The compressed air drives the pumps 6 to develop a 2000 to 2300 psi system outlet pressure. Thus, use of reciprocating piston pumps provides the system with a simple and mechanically efficient means of transporting the coating material.

The air compressor 38 having a rating of about 100 CFM, provides the compressed air that drives the pumps 6. The air compressor 38 is in turn driven by a gas or diesel powered internal combustion engine having a 35–40 horsepower rating and being of the type commonly used unitarily with air compressors. Both the compressor and the engine are supported on a pad 37 formed from an approximately three inch thick piece of butyl rubber or the like. The pad 37 not only provides yet another dielectric barrier, but it further dampens vibrations generated by the engine and compressor assembly It should be appreciated that use of a gasoline or diesel engine in place of an electrically driven motor also eliminates the introduction of a significant electrical potential in the system. Compressed air communicates between the compressor 38 and the pumps 6 through an outlet line 36, dryers 44 and an inlet line 40. All lines utilized in the application vehicle 2 are formed from a composite dielectric material of nylon and butyl rubber or the like and, where applicable, are further fixed to the dielectric mounting board 34 to isolate each line from a potential grounding source. Two draw lines 42 connect each container 8 with a respective one of the pumps 6 to provide a fluid source for the pumps. Also, output lines 45 provide high dielectric strength discharge conduits through which the pressurized coating material passes.

As previously discussed, compressed air introduced into each of the pumps 6 is in close association with the coating material being pumped from the containers 8 through the supply conduit 12 to the transformer 18. Accordingly, the compressed air must not present a grounding path to the closely associated material 26 being pumped. Since the compressor 38 draws air from the atmosphere and compresses it into a greatly reduced volume, the compressor likewise densifies the impurities and moisture that accompany the air being drawn in by a compressor. These accompanying elements are normally found sufficiently spaced apart in the atmosphere, thus air is usually nonconductive. However, when a given volume of air is densified by the compressor 38, these elements become so tightly arranged as to possibly become conductive and create a possible grounding source. The series of dryers 44 are therefore mounted to the dielectric mounting board 34 and are connected with each of the inlet and the outlet lines 40 and 36 respectively. When compressed air, discharged from the compressor 38 through the outlet line 36, is passed through the dryers 44, moisture is eliminated and impurities are filtered out. As a result, the compressed air leaving the dryers 44 and introduced into the pumps 6 through the inlet lines 40 is a nonconductive fluid drive source. The dryers 44, the pumps 6 and the lines 36 and 40 are fixed to the dielectric mounting board 34 by suitable dielectric mounting means such as fiberglass bolts and nuts thus preserving the electrical isolation of the pump components. In summary, the application vehicle 2 provides a dielectric barrier for the coating material 26 stored in liquified form in the containers 8 and provides means for driving the pumps 6 with a nonconductive fluid drive source thus eliminating any introduction of an electrical potential when the coating material is being pumped.

In further accordance with the invention, the supply conduit 12 connecting the application vehicle 2 with a spray head 100 fixed to the applicator boom 16 is likewise isolated from electrical grounding by dielectric barriers The conduit 12 is comprised of a first inner high pressure line 52 and a second, coaxially oriented casing 54 which surrounds the high pressure line 52. The high pressure line 52 is a composite line formed from butyl rubber and nylon having an inner diameter of approximately $\frac{3}{8}''$ and an outer diameter of approximately $\frac{5}{8}''$. The composite material of the line 52 provides sufficient strength to maintain the 2,000 to 2,300 psi outlet pressure in the line generated by the pumps 6. While the wall thickness of line 52 provides a substantial dielectric barrier between the coating material 26 and a potential ground, a further dielectric barrier is added around the line 52 to provide the conduit 12 with a maximum dielectric strength. The casing 54 is preferably formed from black neoprene rubber or the like which surrounds and encases the high pressure line 52. By selecting a casing wall thickness of one inch to two inches, the dielectric strength of the conduit 12 as a whole surpasses the system barrier of 115 kilovolts. To provide yet a further redundancy to the dielectric strength of conduit 12, butyl rubber pads 10 are placed between the ground and the conduit 12. The pads 10 have a one to two inch thickness sufficient to provide an independent dielectric barrier. Also, the pads 10 prevent the line 12 from becoming abraded or scratched during use.

As is shown in FIG. 2 the supply conduit 12 connects with each of the output lines 45 through a quick release fitting 48. The fitting 48, like the other pump components previously discussed, is supported on the dielectric mounting board 34 so as to be spaced from and electrically isolated from any path to ground. The quick release fitting 48 receives in sealing engagement, a correspondingly sized male coupling formed on one end of conduit 12. The fitting 48 is covered with approximately one inch of insulation preferably black neoprene rubber to maintain the dielectric barrier at this point.

Figure 4:
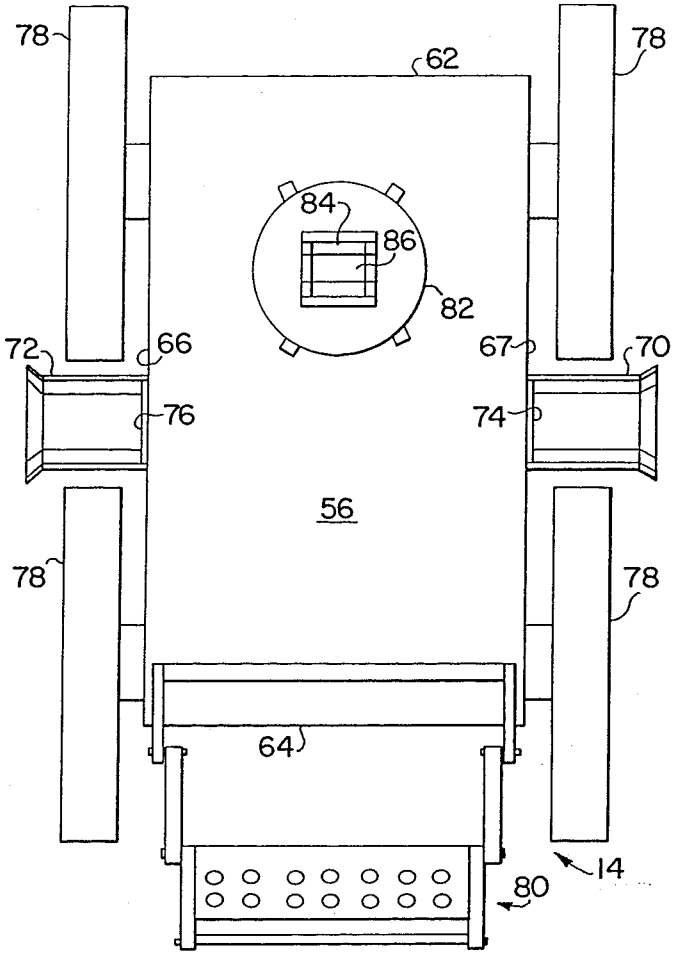
FIG. 4 is a top view of the application cart shown in FIG. 3.
Figure 3:
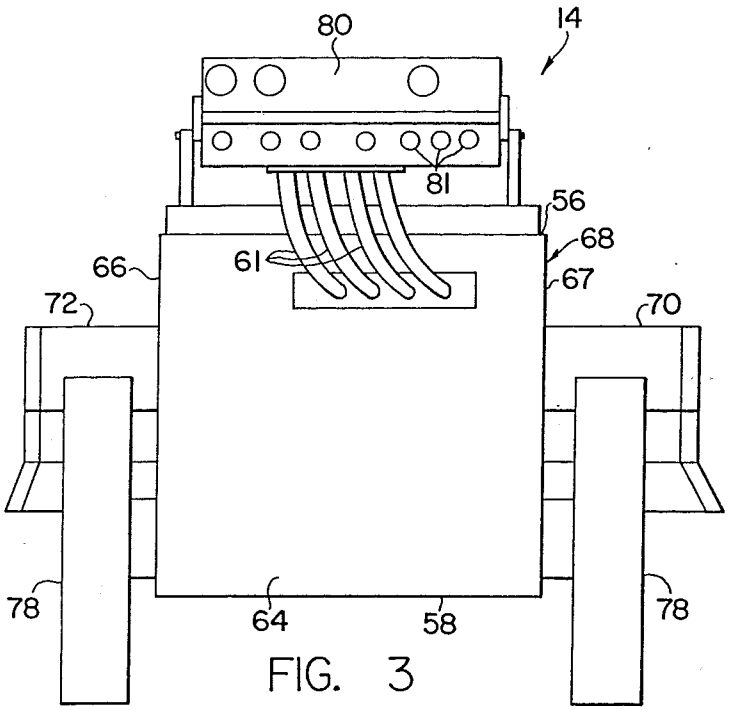
FIG. 3 is a front elevation view of the application cart employed in the system of the present invention.
Figure 5:
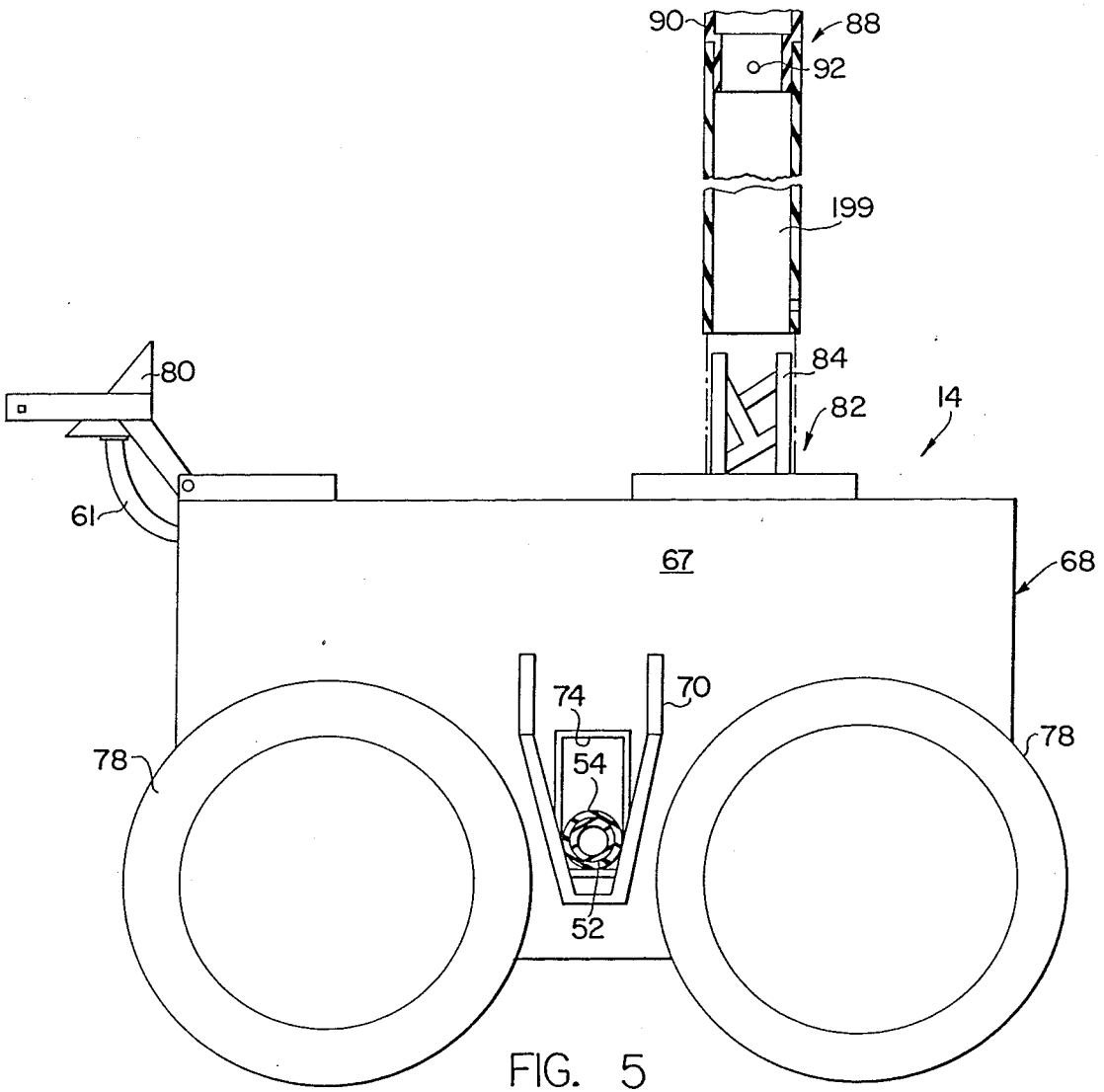
FIG. 5 is a side elevation view of the applicator cart shown in FIG. 3 including a partial showing of the mast which is removably attached to the cart.

FIGS. 3–5 illustrate the application cart 14 of the present invention. The application cart 14, supported by four spaced apart wheels 78, is used as a moveable stand providing a stable and strong support base and provides a dielectric barrier from which the coating material may be applied. It has been found that by forming the application cart from an isophthalic polyester, or vinyl ester material, a cart having both adequate structural and dielectric strength can be provided. The isophthalic polyester is known as EXTREN 500 or 525 and the vinyl ester is known as EXTREN 625. The application cart 14 is generally comprised of a body 68 having six sides respectively defined by top and bottom walls 56 and 58, side walls 66 and 67 and front and rear walls 62 and 64. Each wall is formed from one of the aforementioned EXTREN materials thus enclosing an electrically isolated chamber therein.

Side guides 70 and 72 communicate with openings 74 and 76 formed respectively in side walls 67 and 66. As is best shown in FIG. 4 the side guides 70 and 72 extend outwardly beyond wheels 78 to provide a dielectric channel or V-shaped saddle into which conduit 12 may be received. Since the side guides extend beyond the wheels 78, the conduit 12 cannot become entangled with the wheels when the cart is moved. Depending on the orientation of the transformer 18 with respect to the cart 14, either guide 70 or 72 can be utilized to orient the conduit 12 away from the cart 14 rather than orienting it between the cart and the transformer. Also, as shown in FIG. 5, each of the side guides 70 and 72 is a vertically tapered saddle capable of receiving and fixing the outer circumferential surface of the conduit I2 in wedging engagement therewith. Thus, when the conduit 12 is received and becomes fixed within one of the side guides 70 or 72, the conduit 12 will move with the applicator cart 14 without tensioning the portion of the conduit 12 received inside the chamber in the body 68 of the cart 14.

The application cart 14 is selectively moved into position relative to the transformer 18 by an operator who simply pushes the cart to a selected position. The wheels 78 are rotatably supported on axles formed from fiberglass. Rubber tires are mounted onto fiberglass hubs providing a further dielectric barrier between the ground and the cart body 68. A panel 80, likewise formed from one of the isophthalic polyester or vinyl ester EXTREN materials is fixed to the cart body 68 by support members. The panel 80 allows the operator to control the pumps 6 remotely from the cart 14. The panel 80 houses a series of valves 81 formed from a nonconductive material such as fiberglass that are connected to the inlet air lines 40 at junction 41 of the pumping system through control lines 61. The valves may be connected with the control lines in either an open circuit where the compressed air is simply selectively vented to the atmosphere or in a closed system where the valves restrict the flow of compressed air between the compressor 38 and the pumps 6. By selectively opening and closing the valves, the operator regulates the amount of compressed air that is introduced to the pumps 6. Accordingly, the valves on the panel 80 are control means which limit or increase the pumping action of the pumps 6. Since the control lines 61 running between the panel 80 and the junction 41 are formed from a dielectric composite material similar to lines 40 and because the compressed air communicating through these lines is dryed, nonconductive air, no grounding path is introduced to the control panel 80.

Figure 6:
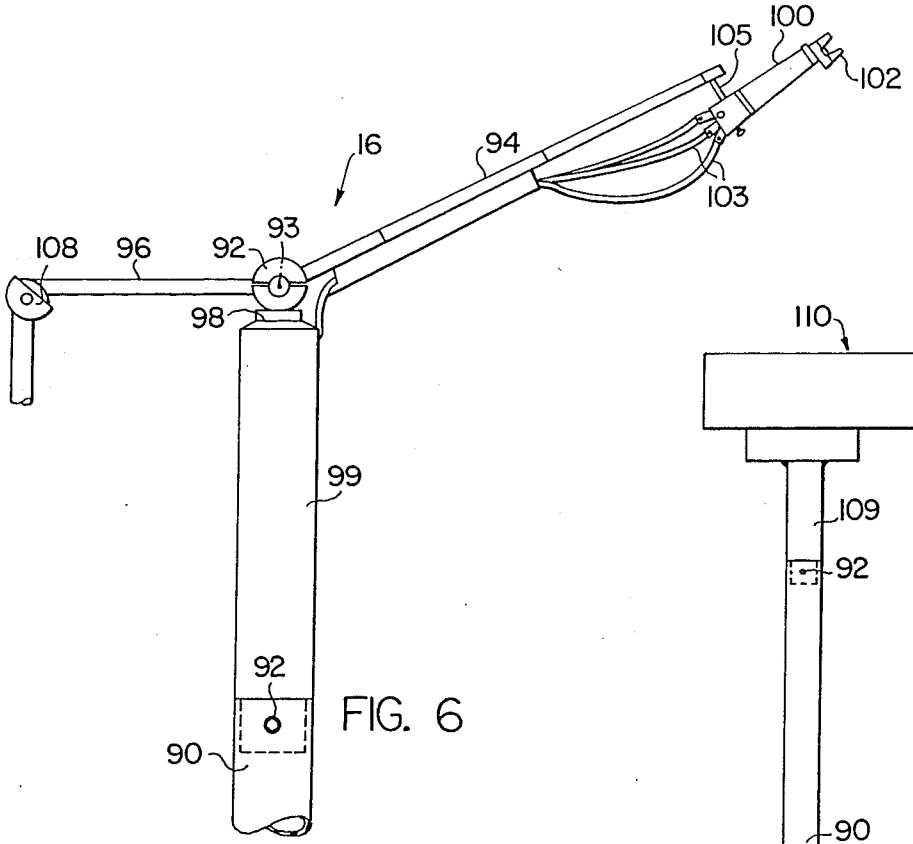
FIG. 6 is a side elevation view of the mast and the applicator boom assembly employed in the present invention.

As shown in FIG. 5 the application cart 14 also comprises a turret 82 which is rotatable in two directions through a 360 degree arc. A turret stem 84 extends upwardly from the base of the turret to receive a hollow extension mast 88 which telescopes down over the stem 84. An opening 86 is formed in the turret 82 to provide access for the high pressure line 52 to communicate through the top surface 56 and upwardly into a hollow mast 88. The mast 88 also provides a vertically extending structure for supporting the spray application boom 16. The elevation of the spray applicator boom 16 is adjustable relative to the cart body 68 by adding or deleting intermediary mast sections 90 which comprise the extension mast 88. The mast sections 90 telescopically are received within corresponding mating ends of one another and are secured by a slip-in groove connection as shown in FIG. 6. Each connection is further secured by a threaded fiber-glass bolt 92 which is threaded through the outer telescoping section and partially extends through the wall of the innerly telescoped section. Each mast section 90 when attached together creates the hollow mast 88.

The mast sections 90 are formed from a dielectric material such as fiberglass which allows the high pressure line 52 to pass through the mast 88 while being received in a dielectric conduit. The casing 54 surrounding the line 52 may be eliminated where the line 52 is recieved within the mast 88. The thickness of the mast wall is approximately one inch. The mast wall thickness combined with the dielectric strength of the high pressure line 52 will provide a dielectric barrier resisting conduction of at least 115 kilovolts. Also, connections between the high pressure line 52 and smaller lines 103 which feed into the system spray head 100 or heads 101 are preferably connected within the dielectric barrier provided by the mast 88 hollow interior or the chamber defined by the cart body 68. In so doing, the fluid connection between these lines is electrically isolated from potential ground or other electrical sources. Also, the smaller lines 103 feeding the spray head 100 and which are exposed along the boom 16 should be encased using a material similar to casing 54. However, since these smaller lines individually transport less conductive fluid, each casing wall thickness may have a substantially reduced dimension ranging from about a quarter to a half inch depending on the size of the line used.

Referring now to the spray application boom 16 illustrated in FIG. 6, an upper mast section 99 supports the spray application boom 16. The section 99 will always be used as the uppermost portion of the mast 88 since an opening in its side wall allows the line 52 or the smaller lines 103 to externally access the boom 16. Also, a mast section 199 (FIG. 5) having two female ends will comprise the other end section of the mast 88 in order to connect the turrent stem 84 and the male end of the next mast section 90. The spray application boom 16 is made from an all fiberglass construction. The mast upper section 99 connects with the boom 16 at joint 92. The joint 92 connects a boom extension arm 94 and a boom control arm 96 with the mast 88. Each arm 94 and 96 is a solid member having a cross-sectional width of about 1.5 inches.

The joint 92 is also rotatably connected to the top of the upper mast section through a cap 98 to allow movement in a horizontal plane The boom extension arm 94 also pivots with the boom control arm 96 about a pin defining axis 93 to generate movement of the extension arm in a vertical plane. The connection 92 may also be of the kind providing angular adjustability between separate boom arm members if desired. In such a connection, the opposing ends of arms 96 and 94 could be clamped together by spaced apart plates, interdigitated and the pin defining axis 93 would pass through the interdigitated end portions. The extension arm 94 is comprised of separate sections threadably attached to one another. By eliminating or adding sections, the length of the extension arm 94 can also be adjusted. A fiberglass sleeve 95 may be employed to enclose the connection between line 52 and the smaller lines 103 feeding the head 100 where it is desired to make this connection externally of the cart body 68 or the mast 88. Thus, the boom 16 allows for motion in two planes relative to the mast 88 and has an extension arm which is adjustable in length.

The spray head 100 is attached to the extension arm 94 at its free end. The spray head 100 and the extension arm 94 are adjustably attached preferably using a fiberglass bolt 105 depending from the head 100 threadably engaging the end of extension arm 94 and fixed by fiberglass locknuts. The spray head 100 is preferably a BINKS model No. 78 head made from a plastic material having a dielectric strength resisting conductivity of 20 kilovolts. The surface of spray head 100 including the clamps connecting the inlet lines 103 thereto, may be coated with a dielectric material, such as material 26, to provide additional dielectric strength. The spray head 100 has adjustable arc nozzles 102 which apply a spray of coating material along an 18" path. At the opposite end of the application boom 16 is fixed the operator control arm 104. The operator control arm 104 is made from a dielectric material such as fiberglass having a cross-sectional diameter of about 1.5 inches and is pivotally attached to the control arm 96 by a ball and socket joint 108. Since all components of the boom 16 and the operator control arm 104 are made from a dielectric material, an operator may hold the free end of arm 104 to position the spray head 100 adjacent the terminals 20, 22 without being harmed. In use, however, it is recommended that the operator stand on an isolation pad 106, shown in FIG. 1, positioned adjacent to the application cart 14. The isolation pad 106 is formed from butyl rubber or the like and has a thickness of one to two inches. Thus, the operator in applying the coating material 26, moves the operator control arm 104 to selectively position the spray head 100 around the terminals 20, 22, the transformer surface 24 and the connecting bus work.

Figure 7:
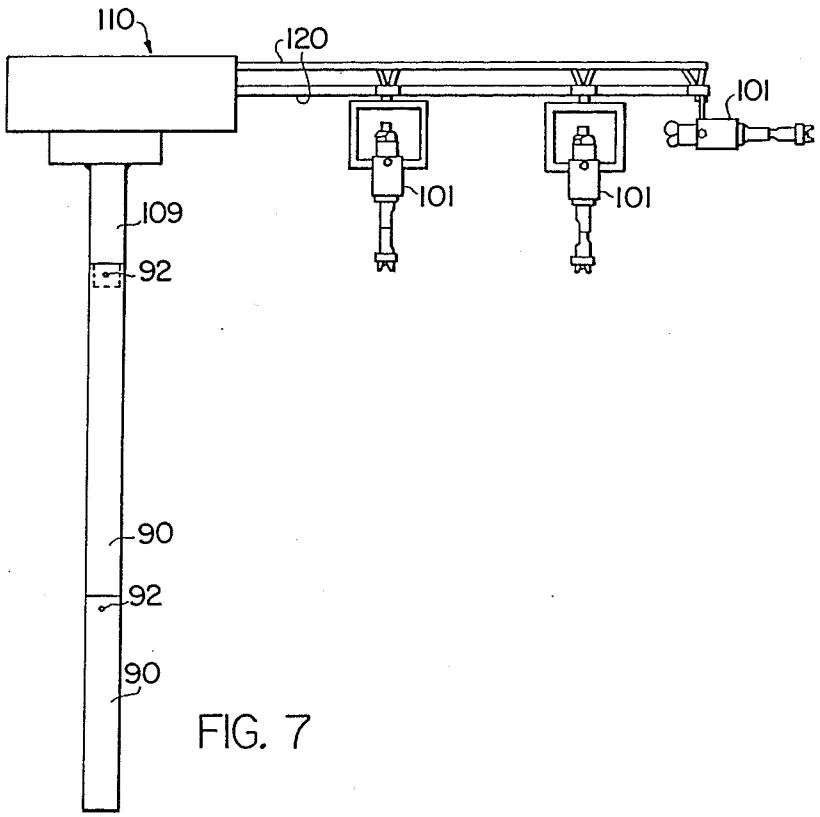
FIG. 7 is an alternative embodiment of an applicator boom used in the system of the present invention employing a spray adapter boom having a plurality of spray heads.

FIG. 7 illustrates an alternative embodiment of a spray adapter boom. The spray boom 110 is fixed and is unitarily mounted to upper mast section 109. The boom 110 and mast section 109 are preferably made from fiberglass or alternatively, from another similar dielectric material,. The applicator boom 110 utilizes three spray heads 101 similar in type to that utilized in FIG. 6. Two of the three spray heads are permanently oriented downwardly to provide a spray path of 36". Support arms 120 extend laterally outwardly from the mast section 109. The arms 120 can be hollow thus allowing small lines to feed the heads 101. The spray adapter boom 110 is utilized to apply a coating material on the top surface 24 of the transformer 18 existing between the terminals 20 and 22. Since this region contains no obstructions, an even coat may be applied to the surface 24 by moving the cart along a path parallel to the length of the transformer.

As previously mentioned, the coating material stored in the containers 8 is a solution comprising a dielectric material mixed with a solvent to liquify the dielectric material for transportation through the conduit 12. A polyester base material is preferably used as the dielectric material. An organic liquifying solvent, such as XYLOL or the like, is mixed with the polyester material to liquify it and the mixed solution is stored in the containers 8. The containers 8 are preferably covered to prevent the solution from prematurely hardening. The liquified dielectric material applied to the transformer is conductive because the liquifying solvent which is mixed with the polyester creates a conductive fluid. The organic liquifying solvent XYLOL has, for example, a conductive capacity of approximately 960 volts per milliliter. It should be appreciated, that because the system electrically isolates the conductive, liquified coating material 26 from any path to ground or any electric potential by providing the previously discussed dielectric barriers therebetween, the bus work and terminal voltages will remain at the transformer rather than passing to a ground or a flashover source through the system.

When the liquified coating material 26 is discharged from the spray head 100, the solvent immediately begins to evaporate. Thus, the dielectric material in solution beings to dry almost on contact with the surface being coated. A flake-glass polyester known as CARBOLINE #1601 has been found to produce the best results when used as the dielectric coating material. CARBOLINE #1601 generates a dielectric barrier of 45 KV for every 1/16" applied. Thus, the coating material 26 can be applied to selected transformer surfaces and buswork in successive coatings to generate a desired dielectric barrier.

In operation, the system of the present invention is versatilely used to coat the top surface, the terminals and bus work on variously sized transformers. The system set-up first includes laying the insulation runner pads 10 around the work area and placing the isolation pad 106 adjacent the transformer 18. The application cart 14 is then brought within the vicinity of the transformer 18 and the mast 88 is made up corresponding to the height of the transformer being serviced. Once the spray head has been connected with the supply conduit 12, the compressor 38 is started, the pumps 6 are activated and the supply conduit 12 is charged with the pressurized coating material. The charging of conduit 12 is regulated by the control valves on panel 80. The operator standing on the isolation pad 106 uses the operator control arm 104 to move the spray head 100 to apply the coating material to selective portions on the transformer 18. It is preferable, also, to use a voltage detector located on the panel 80 to detect any gradual breakdown of the electrical isolating capacity of the system before a possible flashover within the system is allowed to occur. The application of the coating material to the transformer is also monitored by video cameras inputting images into a display screen which is in turn watched by a central control operator whose purpose is to monitor all operations occurring during the application procedure. The video equipment, however, is located a substantial distance away from the operational system components and does not present any electrical interference problems.

By the foregoing, a system for applying a coating material to live, transformer terminals, bus work and adjacent surfaces has been described in the preferred embodiment of the invention. However it should be understood that numerous modifications and substitutions may be made without departing from the spirit of the invention. For example, the spray adapter boom 16 may be connected to the mast segment 99 using a ball and socket joint. Also, the preferred embodiment illustrates the transformer having upwardly extending terminals. However, the present invention can apply a dielectric coating to transformer terminals and bus work extending in any orientation from the transformer. Furthermore, while the preferred embodiment of the invention is intended for use with transformers utilizing a maximum voltage of approximately 45.5 kilovolts, the dielectric strength of the system components can be increased in response to a further voltage increase by increasing the thicknesses in the materials comprising the dielectric barriers. Accordingly the invention has been described by way of illustration rather than limitation.

We claim:

1. A system for selectively applying a coating material to surfaces situated adjacent to or on live high voltage bus work and terminals, said system comprising:

container means for storing a liquified coating material;

pump means capable of pumping said liquified coating material;

barrier means made from a dielectric material for electrically isolating each of said pump means and said container means from potential ground sources by supporting each of said pump means and said container means thereon;

applicator means supported for movement relative to surfaces on or adjacent to live high voltage terminals and bus work for selectively applying said liquified coating material to said surfaces;

said applicator means being formed from a dielectric material electrically isolating it from potential ground source;

conduit means for connecting said pump means with said applicator means, said conduit means formed from a dielectric material isolating it from potential ground sources;

means for providing an electrically nonconductive fluid drive source for driving said pump means; and said pump means being driven by said nonconductive fluid drive source to transport said liquified coating material from said container means through said conduit means to said applicator means for application onto said surfaces;

said means providing an electrically nonconductive fluid drive source includes means for producing compressed air; said pump means includes at least one air driven pump having line means connected with said means for producing compressed air; and wherein said compressed air communicates through said line means to drive said at least one air driven pump.

2. A system as defined in claim 1 wherein said means for producing said compressed air includes an air compressor driven by an internal combustion engine and said line means includes an inlet line and an outlet line and dryer means connected with said inlet and outlet lines between said air compressor and said at least one air driven pump to eliminate from said compressed air produced by said compressor moisture and impurities whereby said compressed air leaving said dryer is electrically nonconductive.

3. A system as defined in claim 2 wherein said barrier means electrically isolating said at least one air driven pump is a vertically extending mounting board formed from fiberglass having a thickness of at least 2 inches, said vertically extending mounting board also supporting said dryer means;

said barrier means electrically isolating each of said container means and said at least one air driven pump further includes a horizontally extending mounting board formed from fiberglass having a thickness of at least 2 inches, said vertically extending mounting board being supported on said horizontally extending mounting board, and wherein said horizontally extending mounting board also supports said air compressor.

4. A system as defined in claim 1 wherein said liquified coating material is comprised of a dielectric material made from a flake-glass polyester in solution with an organic solvent.

5. A system as defined in claim 1 wherein said conduit means comprises a high pressure line formed from a dielectric material for receiving pressurized liquified coating material therein and further comprises a dielectric casing formed about the circumference of said high pressure line to thereby create a dielectric barrier between said coating material received within said high pressure line and potential ground sources.

6. A system as defined in claim 5 wherein said high pressure line is a composite material of nylon and butyl rubber and wherein said casing is formed from neoprene rubber.

7. A system as defined in claim 1 wherein said applicator means further includes cart means, said cart means being formed from a dielectric material having a body supported for movement on wheels, said wheels being mounted to said body through connections made from a dielectric material; and control means, connecting said cart means with said line means for regulating said compressed air to limit or increase the pumping action of said at least one air driven pump.

8. A system as defined in claim 7 wherein said cart further includes a turret supported by said cart body, said turret being freely rotatable in a 360 degree circle and having an opening formed within the center thereof, said turret further comprising a stem extending upwardly and surrounding said opening, and wherein said cart body is formed from an isophthalic polyester or a vinyl ester material.

9. A system as defined in claim 8 wherein said cart body is hollow and said cart body has two opposite side walls, each of said two opposite side walls each having a side guide formed therein, each of said side walls having an opening formed therein coincident with each of said side guides;

each of said side guided being further defined by V-shaped saddles extending laterally from each of said body side walls beyond said wheels and wheels and wherein a selected one of said V-shaped saddles receives said conduit means in wedging engagement therewith to fix said conduit means with said cart means.

10. A system as defined in claim 9 wherein said cart means further includes a mast having an upper end and a lower end, said mast being comprised of mast segments and being connected with said cart body at said mast lower end through said stem, said mast upper end having fixed thereto a boom connection.

11. A system as defined in claim 10 wherein said mast upper end includes a spray adapter boom attached thereto;

said spray adapter boom having a plurality of spray heads depending therefrom; each of said spray heads being permanently oriented in said depending orientation by hollow support arms.

12. A system as defined in claim 10 wherein said applicator means further includes an applicator boom pivotally connected to said mast at said boom connection and said applicator boom is comprised of an extension arm and an oppositely extending control arm, said control arm being pivotally connected with an operator control arm, and said extension arm and said control arm are pivotally connected about two axes relative to said mast by said boom connection, and wherein said mast and said applicator boom are made from fiberglass.

13. A system as defined in claim 12 wherein a spray head is fixed to the free end of said applicator boom extension arm; and said mast is hollow and has a lateral opening in said upper end, wherein said conduit means communicates through one of said openings in said side walls of said cart body and communicates through the opening in the turret and upwardly through the hollow extent of said mast, and through said mast lateral opening along the boom extension arm and is connected with said spray head.

14. A method of selectively applying a coating material to surfaces situated adjacent to or on live, high voltage electric bus work and terminals, said method comprising;

providing a liquified coating material formed of a dielectric material having a polyester base mixed with an organic solvent;

storing said coating material within container means;

electrically isolating said container means having said coating material stored therein from potential ground source by providing a dielectric barrier;

providing applicator means and forming said applicator means from a dielectric material;

supporting said applicator means for movement relative to said surfaces;

providing pump means and electrically isolating it by supporting said pump means on a dielectric barrier;

providing conduit means formed from a dielectric material;

connecting said pump means with said applicator means using said conduit means;

providing an electrically nonconductive fluid drive source;

driving said pump means with said electrically nonconductive fluid drive source;

utilizing said pump means to transport said liquified coating material from said container means through said conduit means to said applicator means; and applying said coating material to said surfaces using said applicator means.

15. A method as defined in claim 14 wherein compressed air drives said pump means and said compressed air prior to entering said pump means passes through dryer means to create said electrically nonconductive fluid drive source.

16. A method as defined in claim 15 wherein said compressed air after passing through said dryer means enters control lines extending between said dryer and a position remote from said dryer means and is regulated by valves located at said remote position.

17. A method as defined in claim 14 wherein providing applicator means further comprises providing moveable cart means for supporting an applicator boom thereon, and manually manipulating said applicator boom to selectively apply said coating material to said surfaces.

18. A method of selectively applying a coating material to surfaces situated adjacent to or on live, high voltage electric bus work and terminals, said method comprising;

providing a liquified coating material;

storing said coating material within container means;

electrically isolating said container means having said coating material stored therein from potential ground source by providing a dielectric barrier;

providing applicator means and forming said applicator means from a dielectric material;

supporting said applicator means for movement relative to said surfaces;

providing pump means and electrically isolating it by supporting said pump means on a dielectric barrier;

providing conduit means formed from a dielectric material;

connecting said pump means with said applicator means using said conduit means;

providing an electrically nonconductive fluid drive source by utilizing compressed air to drive said pump means;

driving said pump means with said compressed air;

utilizing said pump means to transport said liquified coating material from said container means through said conduit means to said applicator means; and applying said coating material to said surfaces using said applicator means.

19. A method as defined in claim 18 further characterized by passing said compressed air through dryer means prior to its entering said pump means.

20. A method of selectively applying a coating material to surfaces situated adjacent to or on live, high voltage electric bus work and terminals, said method comprising;

providing a liquified coating material;

storing said coating material within container means, electrically isolating said container means having said coating material stored therein from potential ground source by providing a dielectric barrier;

providing applicator means including moveable cart means for supporting an applicator boom thereon;

forming said applicator means from a dielectric material;

supporting said applicator means for movement relative to said surfaces;

providing pump means and electrically isolating it by supporting said pump means on a dielectric barrier;

providing conduit means formed from a dielectric material;

connecting said pump means with said applicator means using said conduit means;

providing an electrically nonconductive fluid drive source;

driving said pump means with said electrically nonconductive fluid drive source;

utilizing said pump means to transport said liquified coating material from said container means through said conduit means to said applicator means; and selectively applying said coating material to said surfaces using said applicator means; and manipulating said applicator boom to selectively apply said coating material to said surfaces.

21. A method as defined in claim 20 comprising forming said applicator boom from a fiberglass material and forming said cart from an isophthalic polyester or a vinyl ester material.

22. A method of selectively applying a coating material to surfaces situated adjacent to or on live, high voltage electric bus work and terminals, said method comprising;

providing a liquified coating material formed of a dielectric material having a polyester base mixed with an organic solvent;

storing said coating material within electrically isolated container means;

providing applicator means and forming said applicator means from a dielectric material;

supporting said applicator means for movement relative to said surfaces;

providing pump means and electrically isolating it from potential ground sources;

providing a compressed air source and driving said pump means with said compressed source;

providing conduit means formed from a dielectric material;

connecting said pump means with said applicator means using said conduit means;

utilizing said pump means to transport said liquified coating material from said container means through said conduit means to said applicator means; and applying said coating material to said surfaces using said applicator means.

* * * * *